US007806184B2

(12) United States Patent
Schultz et al.

(10) Patent No.: US 7,806,184 B2
(45) Date of Patent: Oct. 5, 2010

(54) FLUID OPERATED WELL TOOL

(75) Inventors: Roger L. Schultz, Ninnekah, OK (US); Ken Michael, Frisco, TX (US); Pete Dagenais, The Colony, TX (US); Robert L. Pipkin, Duncan, OK (US)

(73) Assignee: Wavefront Energy and Environmental Services Inc., Edmonton (CA)

( * ) Notice: Subject to any disclaimer, the term of this patent is extended or adjusted under 35 U.S.C. 154(b) by 112 days.

(21) Appl. No.: 12/118,255

(22) Filed: May 9, 2008

(65) Prior Publication Data

US 2009/0277639 A1 Nov. 12, 2009

(51) Int. Cl.
*E21B 43/25* (2006.01)
*E21B 34/08* (2006.01)

(52) U.S. Cl. ..... 166/305.1; 166/319; 166/321; 166/334.4; 166/373; 166/374

(58) Field of Classification Search ..... 166/319, 166/321, 334.4, 373, 374, 305.1
See application file for complete search history.

(56) References Cited

U.S. PATENT DOCUMENTS 4,957,167 A 9/1990 Schultz
4,971,365 A 11/1990 Schultz
5,101,907 A 4/1992 Schultz et al.
5,103,906 A 4/1992 Schultz et al.
5,127,477 A 7/1992 Schultz
5,129,454 A * 7/1992 Telfer ..... 166/120
5,180,007 A 1/1993 Manke et al.
5,234,057 A 8/1993 Schultz et al.
5,279,363 A 1/1994 Schultz et al.
5,284,320 A 2/1994 Michael et al.
5,287,741 A 2/1994 Schultz et al.
5,293,937 A 3/1994 Schultz et al.
5,332,035 A 7/1994 Schultz et al.
5,353,875 A 10/1994 Schultz et al.

(Continued)

FOREIGN PATENT DOCUMENTS

WO WO 2008/037069 A1 4/2008

OTHER PUBLICATIONS

U.S. Appl. No. 12/120,633, filed May 14, 2008, entitled "Oscillating Fluid Flow in a Wellbore," Inventors Schultz et al.

(Continued)

*Primary Examiner*—Giovanna C Wright
(74) *Attorney, Agent, or Firm*—Wilmer Cutler Pickering Hale and Dorr LLP

(57) ABSTRACT

A well tool is operable to receive a flow of fluid. The well tool includes a first hydraulic area on which the fluid acts tending to move a first body to substantially seal against passage of fluid through an aperture. A second, larger hydraulic area is provided on which the fluid acts tending to move a second body. The second body is movable by the fluid acting on the second hydraulic to displace the first body from substantially sealing against passage of fluid through the aperture. An energy storing device is provided that is configured to store energy from movement of the second body until at least a specified amount of energy is stored and release the energy when the second body is moved to displace the first body from substantially sealing against passage of fluid through the aperture.

19 Claims, 10 Drawing Sheets

U.S. PATENT DOCUMENTS

| | | | | |
|---|---|---|---|---|
| 5,375,658 | A | 12/1994 | Schultz et al. | |
| 5,799,733 | A | 9/1998 | Ringgenberg et al. | |
| 5,813,460 | A | 9/1998 | Ringgenberg et al. | |
| 5,992,520 | A | 11/1999 | Schultz et al. | |
| 6,073,698 | A | 6/2000 | Schultz et al. | |
| 6,173,795 | B1 * | 1/2001 | McGarian et al. | 175/231 |
| 6,182,753 | B1 | 2/2001 | Schultz | |
| 6,182,757 | B1 | 2/2001 | Schultz | |
| 6,189,392 | B1 | 2/2001 | Schultz | |
| 6,192,984 | B1 | 2/2001 | Schultz | |
| 6,504,258 | B2 | 1/2003 | Schultz et al. | |
| 6,536,530 | B2 | 3/2003 | Schultz et al. | |
| 6,543,544 | B2 | 4/2003 | Schultz et al. | |
| 6,588,507 | B2 | 7/2003 | Dusterhoft et al. | |
| 6,695,061 | B2 | 2/2004 | Fripp et al. | |
| 6,702,019 | B2 | 3/2004 | Dusterhoft et al. | |
| 6,708,761 | B2 | 3/2004 | George et al. | |
| 6,768,214 | B2 | 7/2004 | Schultz et al. | |
| 6,772,837 | B2 | 8/2004 | Dusterhoft et al. | |
| 6,776,238 | B2 | 8/2004 | Dusterhoft et al. | |
| 6,854,522 | B2 | 2/2005 | Brezinski et al. | |
| 6,976,507 | B1 | 12/2005 | Webb et al. | |
| 7,086,479 | B2 | 8/2006 | Schultz et al. | |
| 7,199,480 | B2 | 4/2007 | Fripp et al. | |
| 7,201,230 | B2 | 4/2007 | Schultz et al. | |
| 7,252,142 | B2 | 8/2007 | Brezinski et al. | |
| 7,264,047 | B2 | 9/2007 | Brezinski et al. | |
| 7,299,882 | B2 | 11/2007 | Brezinski et al. | |
| 7,320,367 | B2 | 1/2008 | Brezinski et al. | |
| 7,363,986 | B2 | 4/2008 | Brezinski et al. | |
| 7,404,416 | B2 | 7/2008 | Schultz et al. | |
| 7,404,437 | B2 | 7/2008 | Brezinski et al. | |
| 7,405,998 | B2 | 7/2008 | Webb et al. | |
| 2004/0031610 | A1 | 2/2004 | Schultz et al. | |
| 2004/0112593 | A1 | 6/2004 | McGregor et al. | |
| 2005/0039921 | A1 | 2/2005 | Schultz et al. | |
| 2005/0087336 | A1 | 4/2005 | Surjaatmadja et al. | |
| 2005/0279506 | A1 * | 12/2005 | McKee et al. | 166/375 |
| 2006/0037746 | A1 | 2/2006 | Wright et al. | |
| 2006/0118303 | A1 | 6/2006 | Schultz et al. | |
| 2007/0029078 | A1 | 2/2007 | Wright et al. | |
| 2007/0079968 | A1 | 4/2007 | Schultz et al. | |
| 2007/0084607 | A1 | 4/2007 | Wright et al. | |
| 2007/0295506 | A1 | 12/2007 | Li et al. | |
| 2008/0128126 | A1 | 6/2008 | Dagenais et al. | |
| 2008/0142219 | A1 | 6/2008 | Steele et al. | |
| 2008/0169094 | A1 | 7/2008 | Ehtesham et al. | |
| 2008/0169650 | A1 | 7/2008 | Webb et al. | |

OTHER PUBLICATIONS

U.S. Appl. No. 12/146,401, filed Jun. 25, 2008, entitled "Annular Isolators for Expandable Tubulars in Wellbores," Inventors Brezinski et al.

U.S. Appl. No. 11/928,732, filed Oct. 30, 2007, entitled "Annular Isolators for Expandable Tubulars in Wellbores," Inventors Brezinski et al.

* cited by examiner

FLUID OPERATED WELL TOOL

TECHNICAL FIELD

This disclosure relates to equipment and operations for wells.

BACKGROUND

In certain instances, fluid may be injected into a subterranean formation to improve production from the formation. For example, the fluid may be injected through an injection well into the formation and operate to take the place of product that has been produced from the formation. Additionally or alternatively, the fluid may operate to sweep or displace product from the formation and push it toward a production well.

The fluid injection rate is controlled to prevent fluid bridging between the injection location and the product recovery path (e.g., the production well). If the injection fluid does bridge between the injection location and the product recovery path, the injection fluid does not effectively sweep product to the production well. One manner of controlling the fluid injection rate is to pulse the injection of fluid into the formation.

SUMMARY

One aspect encompasses a well tool is operable to receive a flow of fluid. The well tool includes a first hydraulic area on which the fluid acts tending to move a first body to substantially seal against passage of fluid through an aperture. A second, larger hydraulic area is provided on which the fluid acts tending to move a second body. The second body is movable by the fluid acting on the second hydraulic to displace the first body from substantially sealing against passage of fluid through the aperture. An energy storing device is provided that is configured to store energy from movement of the second body until at least a specified amount of energy is stored and release the energy when the second body is moved to displace the first body from substantially sealing against passage of fluid through the aperture.

Another aspect encompasses a method of pulsing injection fluid into a subterranean zone. In the method, a fluid is received at a first hydraulic area. A force from the fluid acting on the first hydraulic area is stored. The stored force is released to open a valve that releases the injection fluid into the subterranean zone when the stored force exceeds a specified force.

Yet another aspect encompasses a method including receiving a fluid at a first hydraulic area of a downhole tool, receiving a fluid at a second hydraulic area of the downhole tool, and cyclically storing a force from the fluid acting on the second hydraulic area and releasing the stored force to overcome a force from the fluid acting on the first hydraulic area.

DETAILED DESCRIPTION

Figure 1:
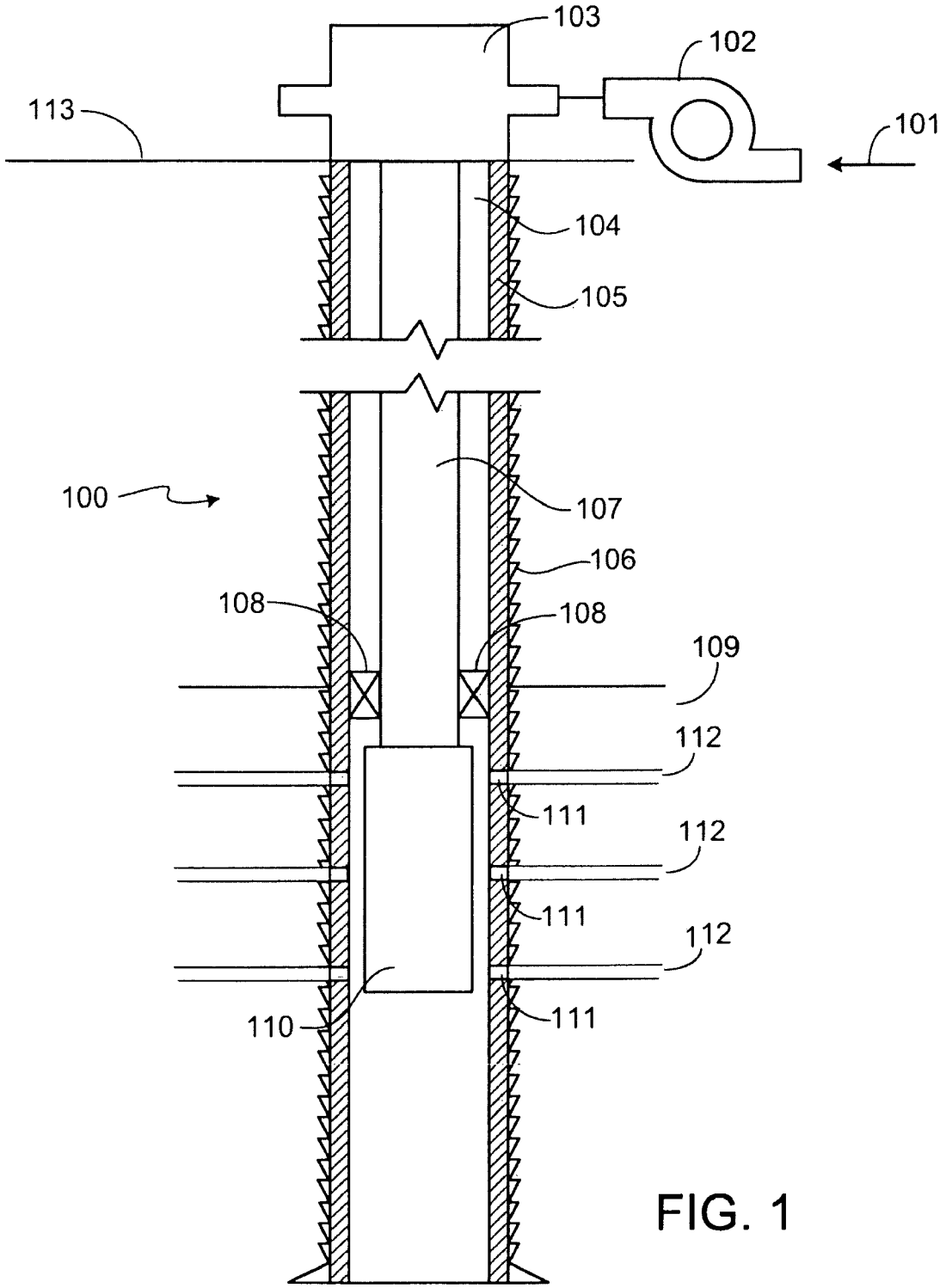
FIG. 1 is a high level view of elements used in some implementations of the present disclosure.

Referring now to the drawings wherein depicted elements are not necessarily shown to scale and wherein like or similar elements are designated by the same reference numeral through the several views.

FIG. 1 illustrates an example injection well 100. The well 100 includes a well bore 104 extending into a subterranean zone 109. In other instances, the well bore 104 can extend through two or more zones. A well casing 105 extends from the surface through the zone 109. In other instances, the casing 105 may cease above the subterranean zone. Cement 106 is pumped around the well casing 105 to secure it to the bore hole 104. A tubing string 107 extends from a well head 103 at the surface 113 through the well bore 104. Sometimes the tubing string 107 carries a packer 108 that is actuable to seal against the wall of the well bore 104 and hydraulically isolate a portion of the well bore 104 from another portion of the well bore 104. Here, the packer 108 is shown isolating a portion of the well bore 104 about the subterranean zone 109 from the remainder of the well bore 104. In other instances, two or more packers (e.g., like packer 108) may be used to isolate multiple portions of the well bore 104. The casing 105 is perforated (perforations 111) and has been stimulated to yield fractures 112 that spread outward from the well casing 105. These fractures 112 provide relatively high permeability pathways through the surrounding subterranean zone. In other instances, the fractures 112 and/or the perforations 111 may be omitted.

Well 100 has a fluid pulsing unit 110 therein carried by the tubing string 107 and residing in the subterranean zone 109. A pump 102 communicates an injection fluid 101 from a fluid source to the fluid pulsing unit 110 via the tubing string 107. In certain instances, the injection fluid includes one or more of water produced from the subterranean zone 109, make-up water, water from a remote source, steam, or other injection fluid. The pump 102 can be operated to provide the fluid at a constant or substantially constant flow rate. The fluid pulsing unit 110 is configured to supply the injection fluid in pulses into the well bore 104 and thus into the subterranean zone 109.

Figure 2:
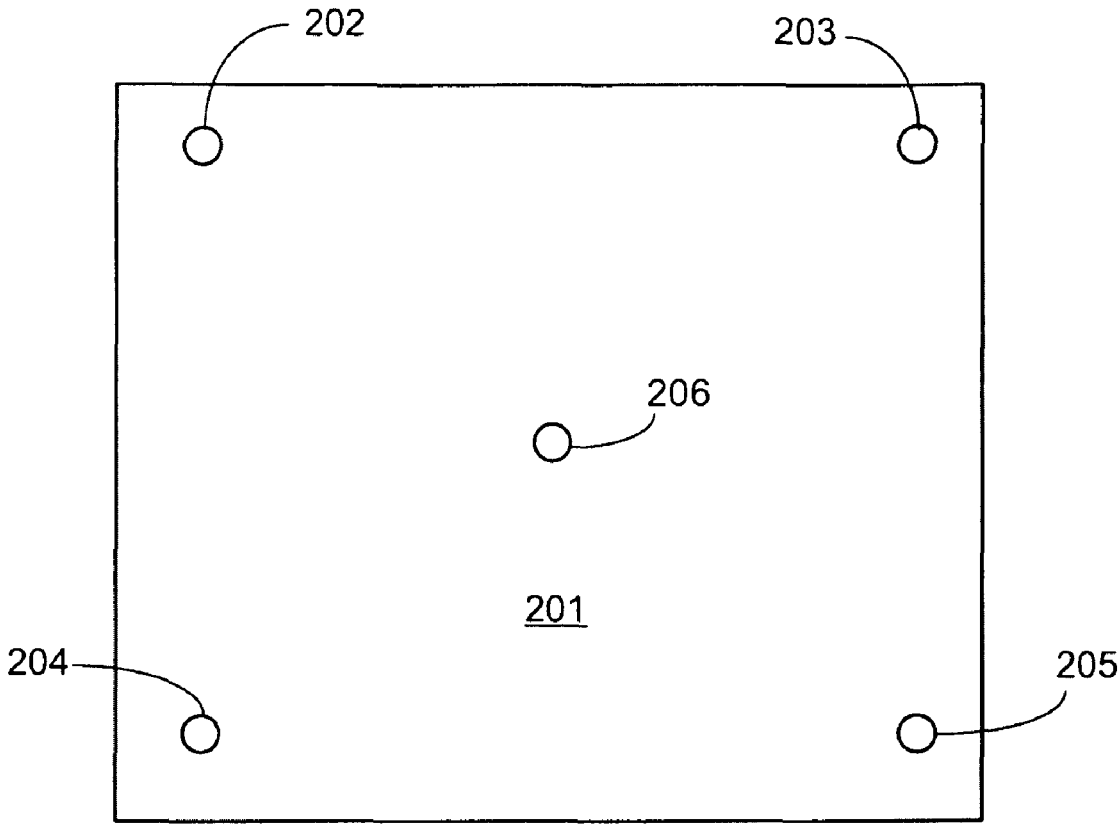
FIG. 2 illustrates a five-spot well pattern often used in a multiple vertical well field.
Figure 3A:
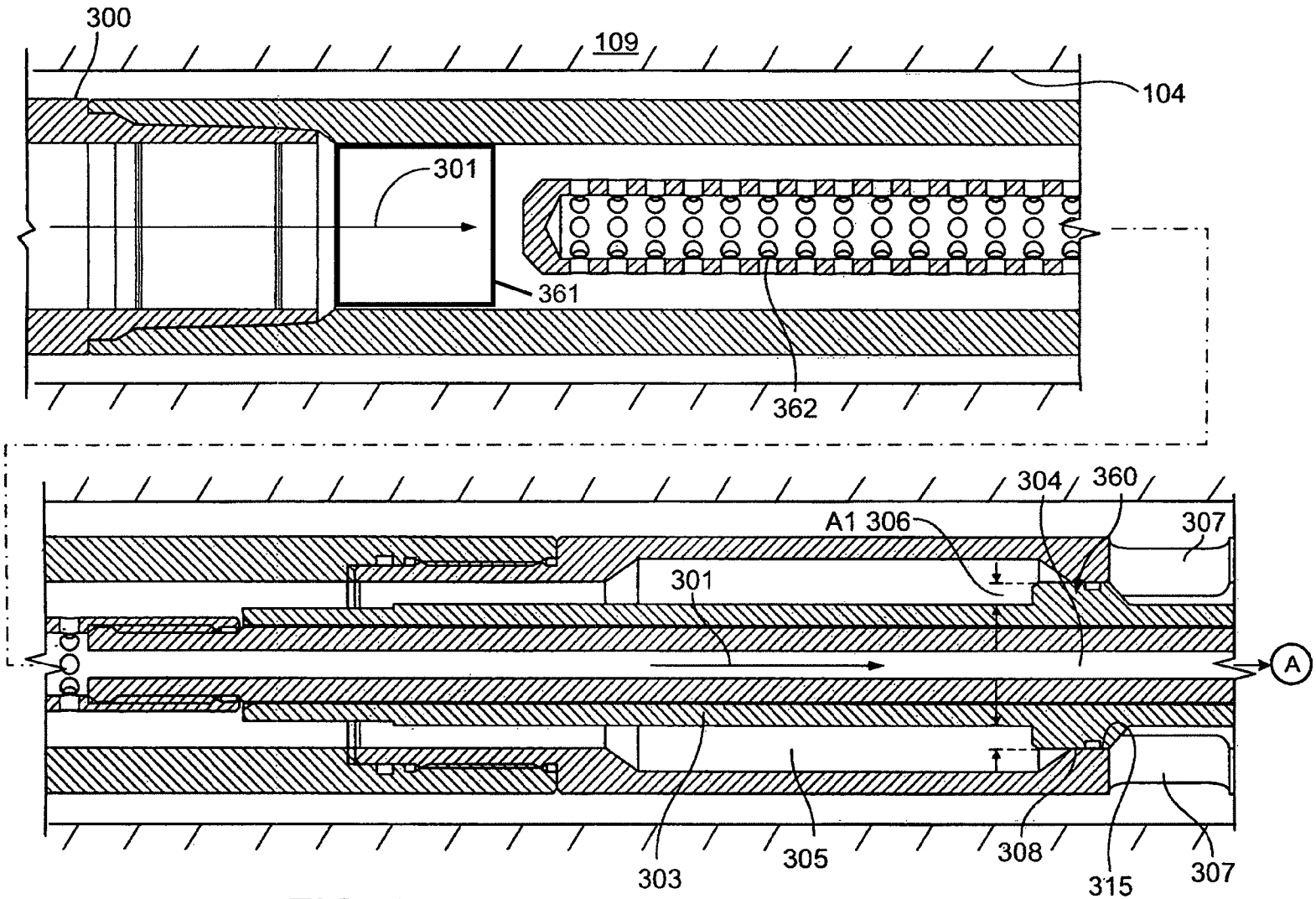
FIGS. 3A-3D is a detailed cross-sectional view of an implementation of a fluid pulse tool.
Figure 3B:
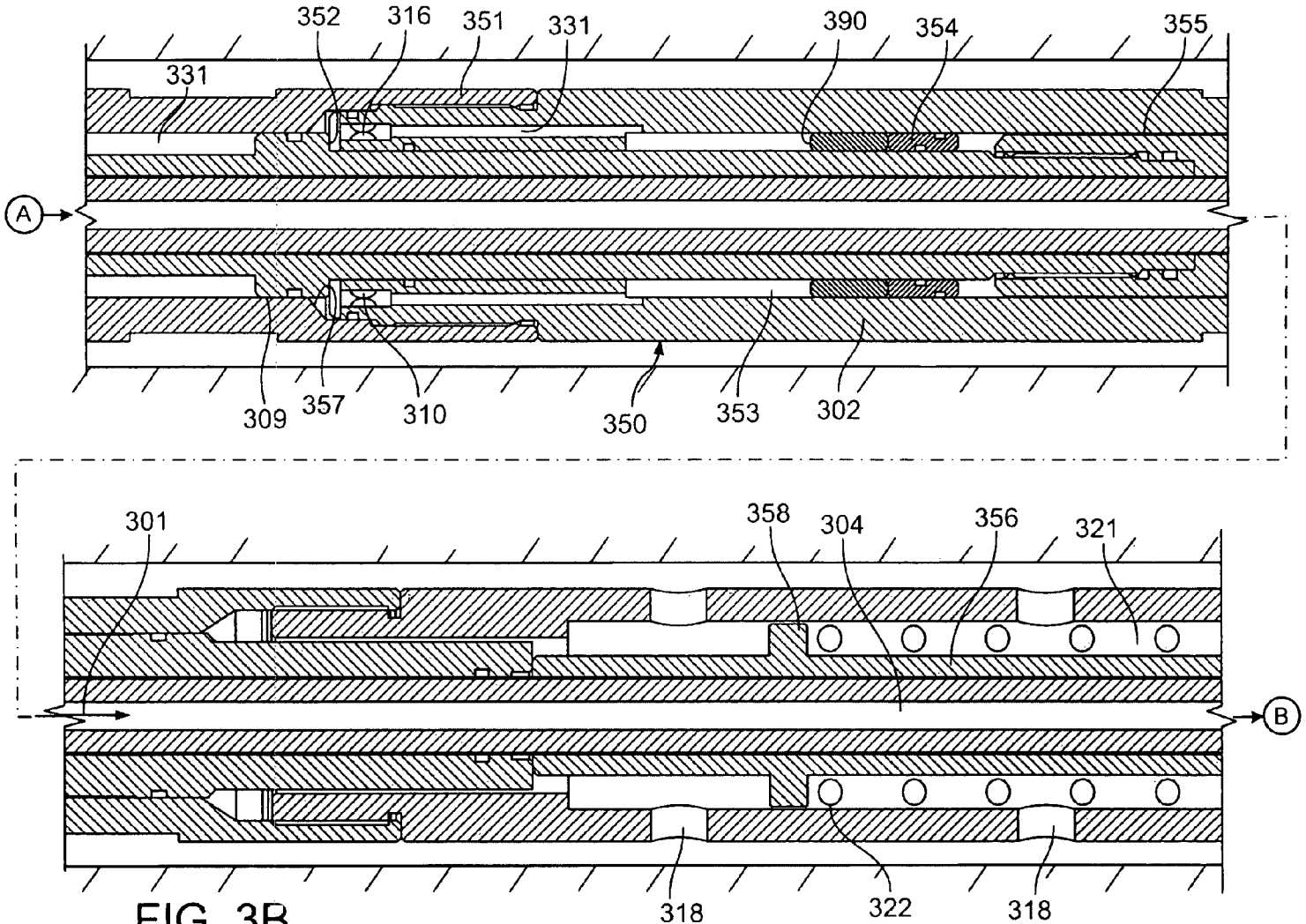
Figure 3C:
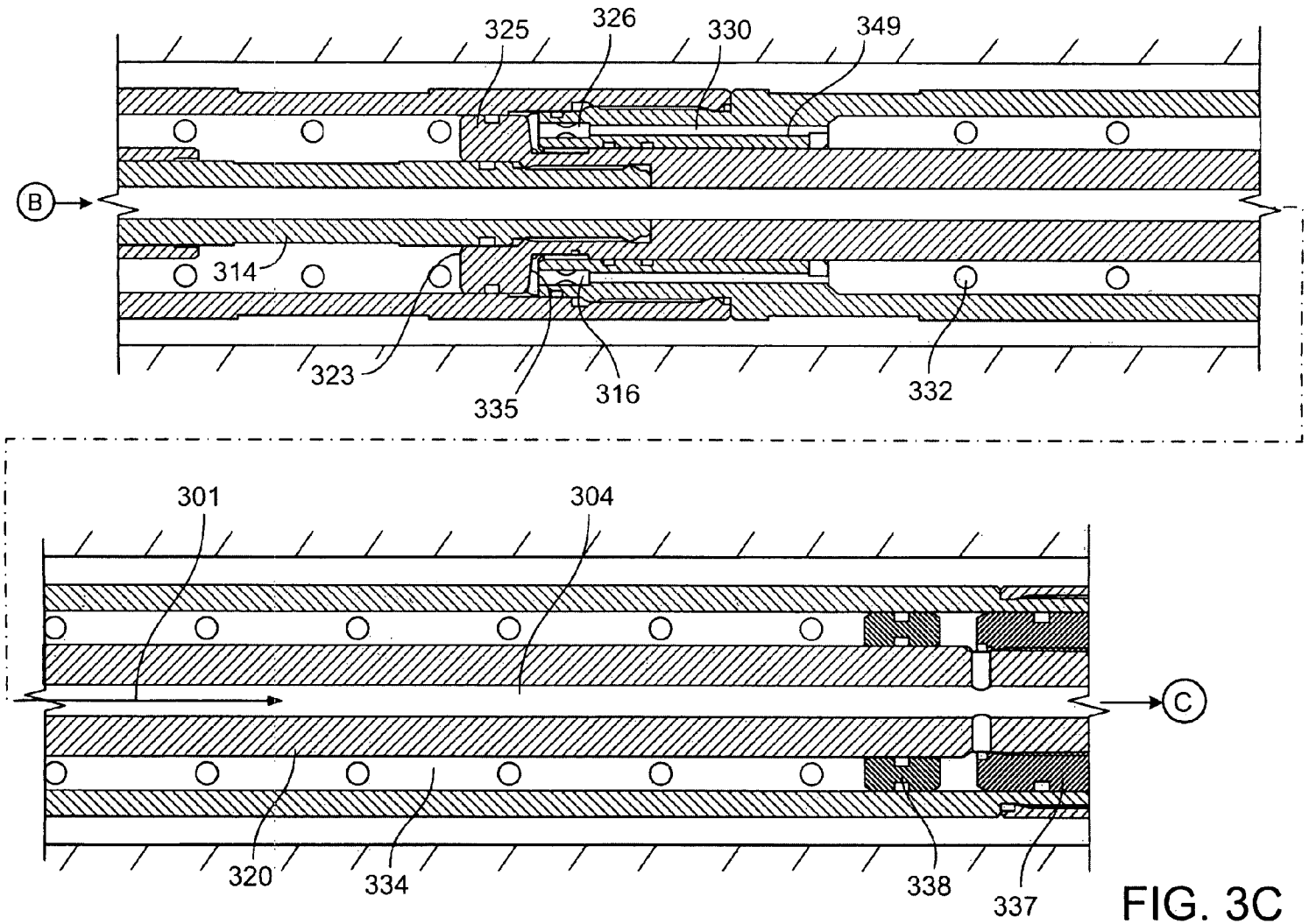
Figure 3D:
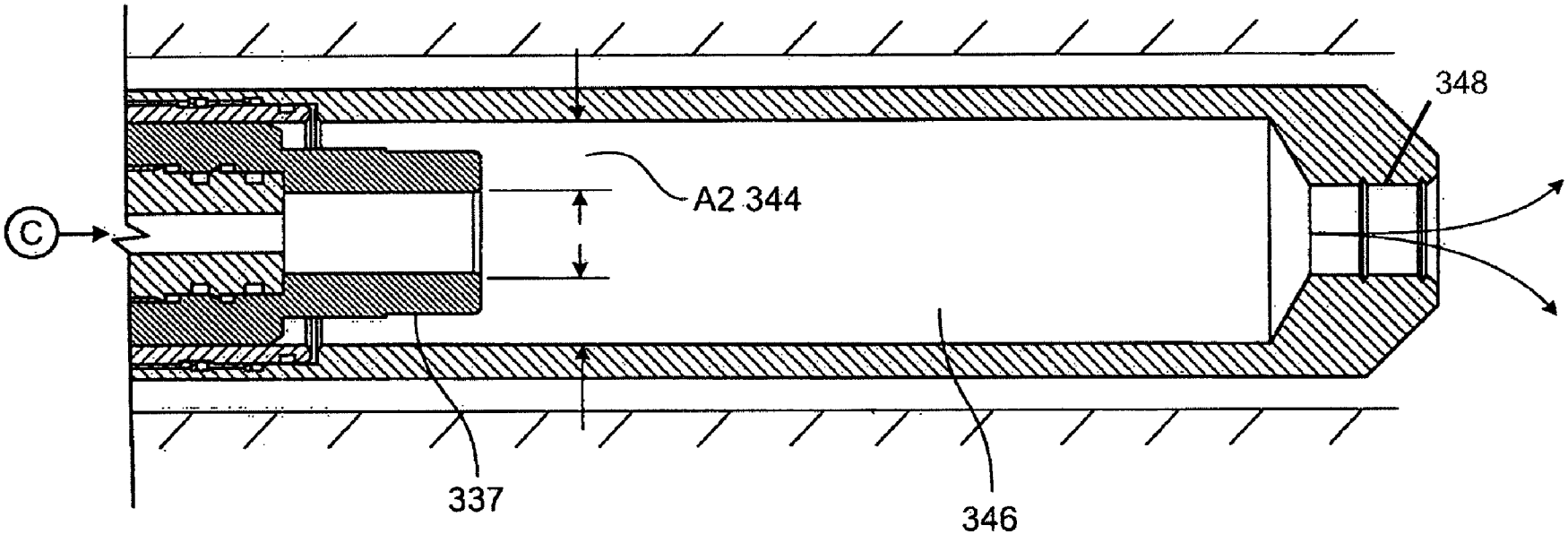

FIG. 2 illustrates a vertical well pattern referred to as a five-spot pattern. In a production area 201, vertical wells 202-205 are placed at the corners of production area 201 and one vertical well 206 is placed in the center of the corner wells. One or more of vertical wells 202-206 may be used as an injection well to increase the production from the other wells 202-206. For example, well 206 may be used as an injection well and fluid may be pumped into a subterranean zone (e.g., subterranean zone 109) to drive fluids towards one or more of the wells 202-205. Injection well 206 would be suitable for fitting with a fluid pulsing unit 110 to increase production from area 201 using pulsed fluid delivered to the subterranean zone(s).

FIGS. 3A-3D show detailed views of an implementation of a fluid pulse tool 350 that is configured to operate as a fluid pulse unit (e.g., fluid pulsing unit 110). Although described in reference to up (toward the left in FIGS. 3A-3D) and down (toward the right in FIGS. 3A-3D), the fluid pulse tool 350 can be oriented in other directions. Thus, use reference to up and down are used for convenience of discussion only, and not meant to imply that the tool 350 (or tool 450 described below) can only be used in vertical orientation.

Fluid pulse tool 350 is configured to fit into a well bore (e.g., well 104). Fluid pulse tool 350 has a tubular outer housing 302 that in an exemplary implementation is configured into six interconnected sections. The outer housing may be fabricated in this fashion (six interconnected sections), for example, to simplify manufacturing and assembly. In other instances, the outer housing 302 may have fewer or more sections.

The upper end of the outer housing 302 is coupled (e.g., threadedly coupled) to a tubing string 300. The lower end of outer housing 302 defines an end chamber 346. In operation, a flow of injection fluid 301 flows from the tubing string 300, through the fluid pulse tool 350 and out the bottom of the end chamber 346. End chamber 346 has a fluid regulator 348 that controls the fluid exiting the end chamber 346 to control the pressure of fluid flow within the pulse tool. In certain instances, the fluid regulator can include one or more of an orifice, an orifice having a restriction that can be adjusted from the surface (e.g., by a mechanical, electrical, hydraulic and/or other signal), a pressure relief valve, a valve actuable to open/close and/or adjustable from the surface (e.g., by a mechanical, electrical, hydraulic, and/or other signal), or other fluid regulator. An inner assembly of fluid pulse tool 350 produces the fluid pulsing action and will now be described.

The inner assembly of fluid pulse tool 350 includes an upper mandrel 303, a lower mandrel 320, and an intermediate mandrel 314 that couples lower mandrel 320 to upper mandrel 303. When coupled, the mandrels form a tube passage 304 that conducts fluid flow 301 from the upper end of fluid pulse tool 350 to end chamber 346. The intermediate mandrel 314 is telescopically received inside of the upper mandrel 303, and fixedly engaged to the lower mandrel 320 to move together with the lower mandrel 320. An apertured inlet body 362 may be coupled, for example by mating threads or otherwise, to the upper end of intermediate mandrel 314. In the implementation of FIGS. 3A-3D, the inlet body 362 limits upward movement of the upper mandrel 303 as is described in more detail below.

Outer housing 302 has a first fluid port 307 where pulsed fluid flows into the well bore 104 and into a subterranean zone (e.g., subterranean zone 109). Port 307 forms part of the "pulse valve" function within fluid pulse tool 350. The pulse valve is closed when fluid from fluid flow 301 is prevented from exiting port 307. The pulse valve is open when fluid from fluid flow 301 can exit port 307.

Upper mandrel 303 has an increased diameter that forms a cylindrical bearing surface 308. The bearing surface 308 is configured to bear against and substantially seal to a cylindrical inner seal surface 315 of outer housing 302. The bearing surface 308 may seal via an O-ring or otherwise form a seal. In other instances, the bearing surface 308 and inner seal surface 315 can have other configurations, such as a male and female hemispherical surfaces, male and female conical surfaces, or other configurations. Bearing surface 308 forms the valve body 360 of the pulse valve that closes off fluid flow to port 307 when upper mandrel 303 is moved toward end chamber 346 (as depicted in FIGS. 3A-3D). Bearing surface 308 resides off of inner seal surface 315, allowing flow from fluid flow 301 through port 307, when upper mandrel 303 is moved away from end chamber 346. The portion of upper mandrel 303 and outer housing 302, disposed above bearing surface 308 and toward the upper end of the outer housing, form a first fluid chamber 305. The sealed area between the inner seal surface 315 and the bore of upper mandrel 303 above bearing surface 308 forms a first hydraulic area A1 306. Fluid flow 301 acts on hydraulic area A1 306 biasing the pulse valve closed, i.e. tending to move bearing surface 308 into substantially sealing contact with the inner seal surface 315.

Downstream of port 307 (towards end chamber 346), the diameter of upper mandrel 303 again increases forming bearing surface 309 that bears against and substantially seals to an inner surface 357 of outer housing 302. The bearing surface 308 may seal via an O-ring or otherwise form a seal.

Downstream from bearing surface 309 (towards end chamber 346), outer housing 302 has a reduced inner diameter section 351 configured with longitudinal holes 331 extending therethrough. The inner surface of reduced diameter section 351 is substantially sealed (by O-ring or otherwise sealed) to the outer surface of upper mandrel 303.

Bearing surface 309 forms a downwardly facing ledge 352 that abuts reduced diameter section 351 to stop movement of upper mandrel 303 downward (towards end chamber 346). Ledge 352 also forms an upper end of a hydraulic chamber 353. The lower end of the hydraulic chamber 353 is defined by a piston 354 substantially sealing the inner surface of the outer housing 302 and the outer surface of the upper mandrel 303 by O-rings or in some other manner. The hydraulic chamber 353 contains a fluid, such as water, hydraulic oil, or another fluid (liquid and/or gas). An additional, compressible fluid of the same or different composition as the fluid in chamber 353 and/or a spring device (coil, Belleville, polymer, or other) can be provided to bias the piston 354 into chamber 353. Some of the longitudinal holes 331 in the reduced diameter section 351 are fitted with check valves 310 and others may operate as flow restricting orifices or may have flow restricting orifice devices 316 therein. The check valves 310 are oriented to allow fluid flow relatively freely in the upward direction, but block fluid flowing in the downward direction. Thus, fluid flowing in the downward direction (i.e. downstream) is restricted by the longitudinal holes 331 and/or orifice devices 316. If orifice devices 316 are provided, the magnitude of the flow restriction can be adjusted by changing the orifice devices 316 to ones of different specification.

The lower end of hydraulic chamber 353 is defined by a shoulder 390 of the piston 354 about the lower end of the upper mandrel 303. In this instance, the shoulder 390 of the piston 354 resides on an additional mandrel body 355 carried on the upper mandrel 303, but shoulder 390 of the piston 354 could otherwise reside on the upper mandrel 303 itself. An outer surface of upper mandrel 303 is substantially sealed to an inner surface of intermediate mandrel 314 via O-rings or otherwise sealed.

The upstream end of lower mandrel 320 is disposed apart from lower end of the upper mandrel 303 a specified distance, and a perch mandrel 356 is slidingly received over the intermediate mandrel 314 in that distance.

Below the lower end of intermediate mandrel 314, outer housing 302 has port holes 318. Lower mandrel 320 has an increased diameter bearing surface 325 that bears against and is substantially sealed to (e.g., by O-ring or otherwise) an inner surface of outer housing 302. A first spring chamber 321 carries a first spring 322 which contacts a shoulder 358 on the perch mandrel 356 and ledge 323 adjacent to bearing surface 325 of the lower mandrel 320. Spring 322 biases lower mandrel 320 downward, and stores energy when compressed and releases energy in expansion. Although depicted as a coil spring, spring 322 can be numerous other types of springs including Belleville washers, polymer bushings, a compressible fluid, or other spring. Spring chamber 321 is vented to the well bore by ports 318, so the chamber does not hold pressure.

The inside of outer housing 302 has a lower reduced diameter section 349 about the lower mandrel 320 and configured with longitudinal holes 330 extending therethrough. The inner surface of reduced diameter section 349 is substantially sealed (e.g., via O-ring or otherwise) to the outer surface of lower mandrel 320 and to outer housing 302.

The bearing surface 325 is adjacent downwardly facing ledge 335 that abuts the reduced diameter section 349 to limit lower mandrel 320 from moving downward (towards end chamber 346). Ledge 335 also forms an upper end of a hydraulic chamber 334. The hydraulic chamber 334 contains a fluid, such as water, hydraulic oil, or another fluid (liquid and/or gas). Some of the longitudinal holes in the reduced diameter section 349 are fitted with check valves 326 and others may operate as flow restricting orifices or may have flow restricting orifice devices 316 therein. The check valves 326 are oriented and the restricting orifices 316 configured such that fluid flows relatively freely in the upward direction, but fluid flowing in the downward direction is restricted.

Hydraulic chamber 334 is fitted with a second spring 332 captured between a piston 338 and reduced diameter section 349. As with spring 322, spring 332 can be numerous other types of springs including Belleville washers, polymer bushings, a compressible fluid, or other spring, and need not be the same type of spring as spring 322. The piston 338, fitted over lower mandrel 320, forms the lower end of the hydraulic chamber 334. The piston 338 is substantially sealed (e.g., via O-rings or otherwise) to the outer surface of lower mandrel 320 and the inner surface of outer housing 302. The back side of the piston 338, opposite hydraulic chamber 334, is communicated with the pressure in the tube passage 304. Second spring 332 biases piston 338, and thus (hydraulically) lower mandrel 320, downward.

Below chamber 334, lower mandrel 320 is coupled to an end bushing 337. The end bushing 337 is substantially sealed (e.g., via O-rings or otherwise) to an inner surface of outer housing 302. The sealed area between the inner diameter of outer housing 302 and the bore of lower mandrel 320 define a second hydraulic area A2 344. The second hydraulic area A2 344 is greater than the first hydraulic area A1 306.

In operation, the upper mandrel 303 is positioned with pulse valve in a closed state (with bearing surface 360 substantially sealing with inner seal surface 315) and fluid from flow 301 flowing through tube passage 304 into the end chamber 346. As noted above, the fluid flow 301 may be provided (e.g., from a pump at the surface) at a constant and/or non-pulsing flow rate. Flow regulator 348 regulates pressure to maintain a specified pressure in the end chamber 346.

First spring 322 and second spring 332 bias the lower mandrel 320 downward. As pressure builds up in end chamber 346, the force acting over hydraulic area A2 344 exceeds the spring forces, and lower mandrel 320 starts to move upward compressing first spring 322 and second spring 332. The intermediate mandrel 314 moves upward with the lower mandrel 320.

As the lower mandrel 320 moves upward, fluid in hydraulic chamber 334 flows through the check valves 326 and flow restricting orifice devices 316 in longitudinal holes of lower reduced diameter section 349. As mentioned above, the check valves 326 are configured to allow flow upward through the longitudinal holes and block downward flow. Upward movement of the lower mandrel 320 is damped by the restriction created by flow restricting orifice devices 316 and check valves 326. Primarily, however, the compressional spring force of first spring 322 and compressional spring force of second spring 332 resists this motion, and first spring 322 reacts against the upper mandrel 303. The upper mandrel 303 is held in place by pressure applied at hydraulic area A1 306. Therefore, the springs 332 and 322 act to store energy from the hydraulic force applied at A2 344.

When the spring force in first spring 322 exceeds the downward force applied at hydraulic area A1 306, then the upper mandrel 303 starts to move upward. As the upper mandrel 303 moves upward, fluid in hydraulic chamber 353 flows through check valves 310 and flow restricting orifice devices 316 in longitudinal holes of upper reduced diameter section 351. Upward movement of the upper mandrel 303 is damped by the restriction created at reduced diameter section 351 by flow restricting orifice devices 316 and check valves 310. When the upper mandrel 303 moves far enough to start to open the pulse valve (i.e. lift bearing surface 360 out of sealing contact with inner seal surface 315), fluid from fluid flow 301 starts to flow out of port 307 and the pressure (and thus force) applied to hydraulic area A1 306 rapidly drops. The stored energy in first spring 322 is expended as it moves upper mandrel 303 rapidly upward and drives the pulse valve open. This opening of the pulse valve begins a pulse of fluid released through port 307, and thus into the subterranean zone (e.g., zone 109).

With the pulse valve open, the pressure applied at both hydraulic areas A1 306 and A2 344 drop. Although fluid flow between bearing surface 360 and inner seal surface 315 tends to maintain the valve open, eventually the flow between the surfaces decreases and the tendency of that flow to maintain the valve open also decreases. The pressure drop at A2 344 allows second spring 332 to push lower mandrel 320 and intermediate mandrel 314 downward. Eventually, the intermediate mandrel 314 moves low enough that the apertured inlet body 362 abuts upper mandrel 303 and begins to draw the upper mandrel 303 downward with the intermediate mandrel 314 and lower mandrel 320. As the mandrels are moved downward, fluid in hydraulic chamber 353 and hydraulic chamber 334 flows downward through longitudinal holes in the upper reduced diameter portion 351 and lower reduced diameter portion 349, respectively. The check valves 310 and 326 block flow through some of the longitudinal holes causing the entire flow to pass through restricting orifice devices 316. The fluid flowing through the restricting orifice devices 316 operates to dampen downward movement of the mandrels and, correspondingly, slow closure of the pulse valve. This dampening can reduce, minimize or prevent "chatter" in the pulse valve of fluid pulse tool 350. Eventually, the pulse valve closes (bearing surface 360 substantially sealing with inner seal surface 315) and stops flow of injection fluid through port 307. This closing of the pulse valve ceases a pulse of fluid released through port 307, and thus into the subterranean zone (e.g., zone 109). Thereafter, the process can begin again and can continue to cycle while injection fluid flow 301 continues.

Fluid pulse tool 350 is fluid driven and has no external drive sources or components. A continuous flow of fluid flow 301 causes repetitive pulses of fluid to be injected into the subterranean zone via port 307 according to the cycle described above. The characteristics of the fluid pulses can be controlled by varying the rate of the first and second springs 322, 332, the dampening on the upper mandrel and lower mandrel (e.g., by varying the number and restriction characteristics of flow restricting orifices 316), the viscosity of the fluid in hydraulic chamber 353, the regulating characteristics of flow regulator 348, the flow rate of fluid 301 and other characteristics of the tool 350. For example, the rate at which the pulse valve closes (and correspondingly the amount of time the pulse valve remains open) can be controlled by increasing the dampening provided by the fluid in hydraulic chambers 353 and 321. The dampening can be increased by increasing the viscosity of the fluid in chamber 353, decreasing the ratio of restrictor devices 316 to check valves 310 and 326, providing more restrictive restrictor devices 316, and in other manners.

Fluid pulse tool 350 may be used in combination with a fluid accumulator 361 that is in series with the fluid flow 301. Accumulator 361 operates to receive fluid flow 301 from tubing string 300 under pressure, maintain the pressure of the accumulated fluid, and release the accumulated fluid back into the tubing string 300 when the pressure of fluid in tubing string 300 drops below the pressure in the accumulator 361. Thus, the accumulator 361 provides additional fluid for flow 301 when the flow through ports 307 begins to deplete the injection fluid inventoried in the tubing string 300 and outpaces the pumping rate of the injection fluid pump. The additional fluid allows additional fluid to be injected into the subterranean zone with each pulse of the fluid pulse tool 350.

Figure 4A:
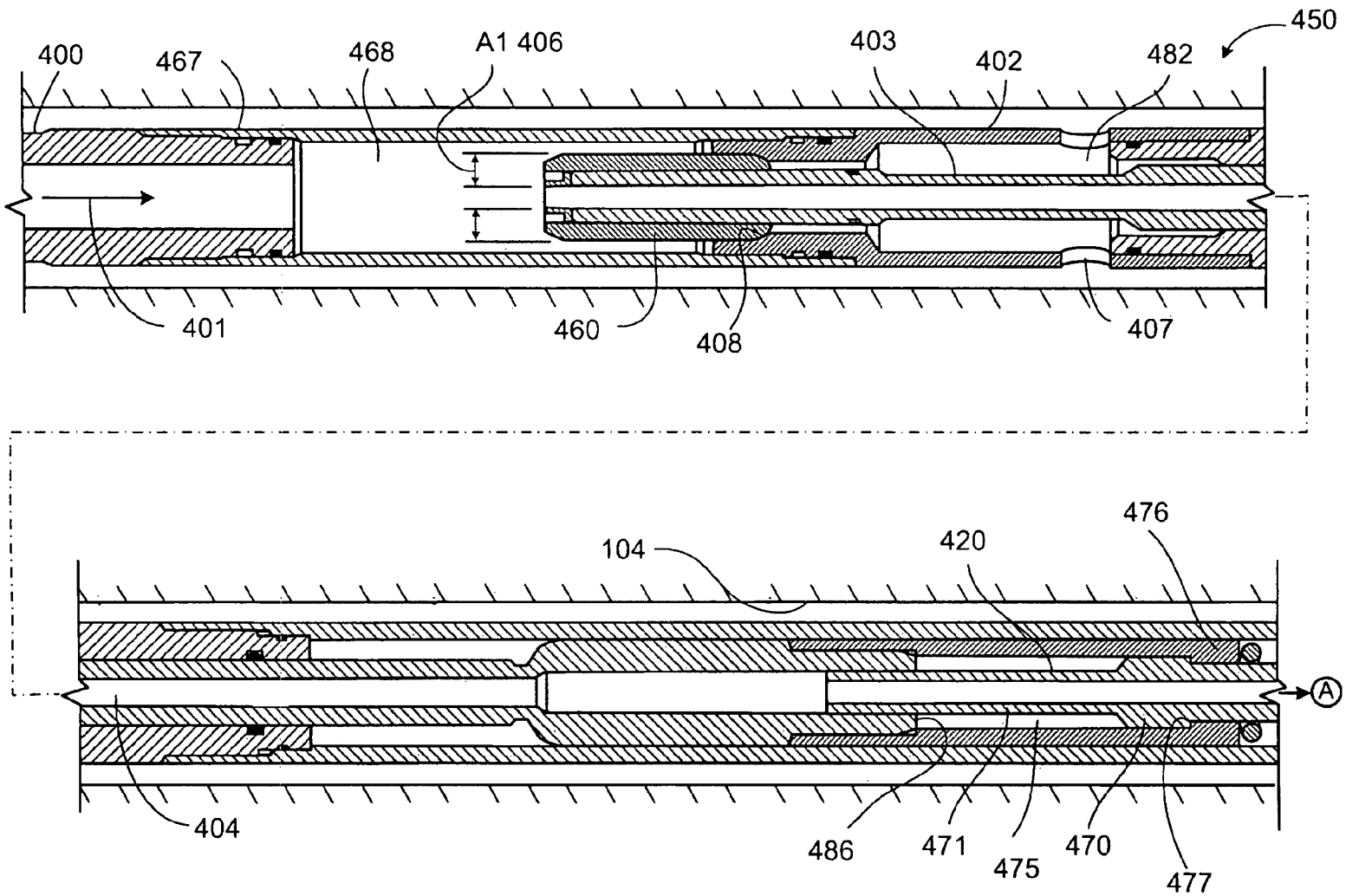
FIGS. 4A-4C is a detailed cross-sectional view of another implementation of the fluid pulse tool.
Figure 4B:
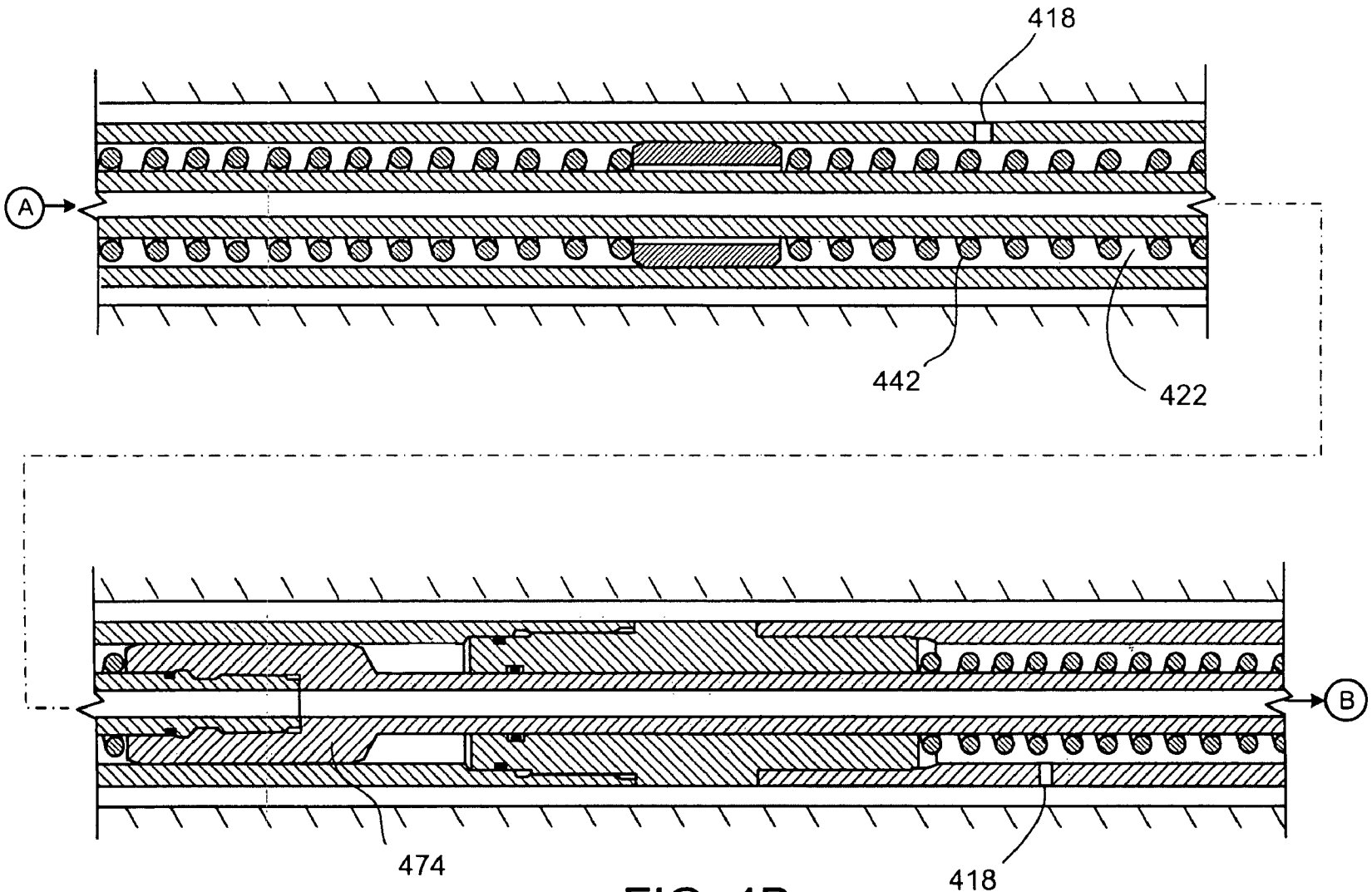
Figure 4C:
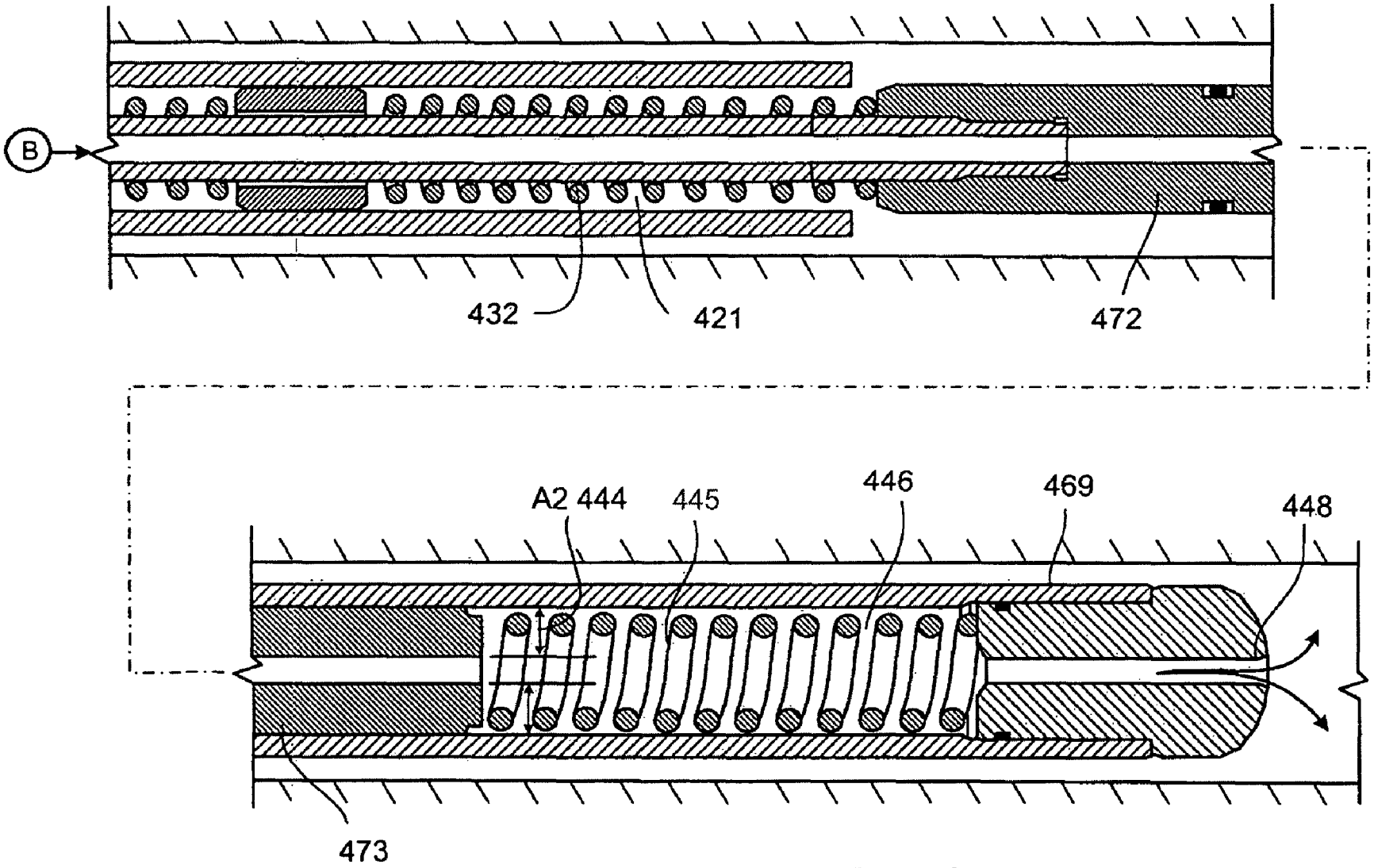

FIGS. 4A-4C show detailed views of a second implementation of a fluid pulse tool 450 that is configured to operate as a fluid pulse unit (e.g., fluid pulsing unit 110). In some instances, the fluid pulse tool 450 may be used to introduce higher fluid flow rates of injection fluid compared to the tools illustrated in FIGS. 3A-3D. Like the fluid pulse tool 350 of FIGS. 3A-3D, the fluid pulse tool 450 is configured to fit into a well bore. Fluid pulse tool 450 includes a tubular outer housing 402. As shown, the outer housing 402 is configured into multiple interconnected sections, for example, to simplify manufacturing and assembly. In other instances, the outer housing 402 may have fewer or more sections than shown in FIGS. 4A-4C.

The upper end 467 of the fluid pulse tool 450 is coupled (e.g., threadingly coupled) to a tubing string 400 and defines a fluid inlet 468 for accepting a flow of injection fluid 401 from the tubing string 400. The lower end 469 of the fluid pulse tool 450 forms an end chamber 446. In operation, a flow of injection fluid flows from, the tubing string 400, through the fluid pulse tool 450 and out the bottom of the end chamber 446. The end chamber 446 includes a fluid regulator 448 similar to fluid regulator 348. A first spring 445 is disposed in the end chamber 446. Although depicted as a coil spring, spring 445 can be any of a number of different types of springs including Belleville washers, polymer bushings, a compressible fluid, or other spring. The spring 445 damps downward movement of the lower mandrel 420. In some instances, the spring 445 can be provided without the spring 445 or with another mechanism, such as a hydraulic damper, to damp downward movement of the lower mandrel 420.

The fluid pulse tool 450 also includes an upper mandrel 403 and a lower mandrel 420. The upper and lower mandrels 403 and 420 form a tube passage 404 that conducts the injection flow 401 from the inlet 468 of the fluid pulse tool 450 to the end chamber 446. The lower mandrel 420 includes a first enlarged portion 470 at a first end 471, a second enlarged portion 472 at a second end 473, and a third enlarged portion 474 disposed between the first and second enlarged, portions 470, 472. The first enlarged portion 470 of the lower mandrel 420 is telescopically received within a cavity 475 formed at a lower end 476 of the upper mandrel 403. The first enlarged portion 470 is retained within the cavity 475 by a lip 477 formed at the lower end of the upper mandrel 403. The second enlarged portion 472 of the lower mandrel 420 forms a seal (via an O-ring or otherwise) with an inner surface 479 of the outer housing 402 to prevent fluid within the end chamber 446 from entering a spring chamber 421 formed between the lower mandrel 420 and the outer housing 402. A spring 432 is disposed in the spring chamber 421. A spring 442 is disposed in a spring chamber 422 defined between the third enlarged portion 474 of the lower mandrel 420 and the lip 477. As shown, the springs 432 and 442 are a pair of coil springs, although a single coil spring or more than two coil springs may be used. Further, as with spring 445, springs 432 and 442 can be numerous other types of springs including Belleville washers, polymer bushings, a compressible fluid, or other spring, and springs 445, 432, and 442 need not be the same type of spring. A seal is formed between the outer housing 402 and the upper mandrel 403 prevents fluid within the spring chamber 422 from escaping upwards through the fluid pulse tool 450. The spring chambers 421 and 422 are in fluid communication with each other and are vented to the well bore by ports 418. The flow of fluid through the ports 418 operates affect the pulsing rate of the pulse valve and to dampen movement of the mandrels 403, 420 and, correspondingly, affect opening and closure of the pulse valve. This dampening can reduce, minimize, or prevent "chatter" in the pulse valve of fluid pulse tool 450. Although two ports 418 are shown, the fluid pulse tool 450 may include more or fewer ports 418. Adjusting the size or quantity of the ports 418 can affect the flow rate of fluid into and/or out of the spring chambers 421, 422 and, therefore, the pulsing of the injection fluid 401 into the well bore. For example, decreasing the flow area provided by ports 418 in the spring chamber 421, damps the movement in storing and releasing energy in spring 432. Decreasing the flow area provided by ports 418 in the spring chamber 422 daps the movement in storing and releasing energy in spring 442.

The upper mandrel 403 includes an enlarged portion forming a valve body 460 operable to engage a bearing surface 408 formed on an inner wall of the outer housing 402. The valve body 460 and the bearing surface 408 form a pulse valve. When the pulse valve is closed, the valve body 460 seats against the bearing surface 408, preventing injection fluid 401 from exiting port 407 formed in the outer housing 402. The port 407 provides communication between an annulus 482 and the exterior of the fluid pulse tool 450. The annulus 482 is isolated from the spring chamber 422 by the seal 481. When the pulse valve is open, a portion of the injection fluid 401 exits the fluid pulse tool 450 through the port 407.

In operation, the pulse valve is in a closed state, i.e. the valve body 460 abuts the bearing surface 408, and the injection fluid 401 from the string 400 is introduced into the interior of the fluid pulse tool 450 via the inlet 468. The injection fluid 401 may be provided at a constant and/or non-pulsing flow rate. The injection fluid 401 has a pressure that acts on a hydraulic area A1 406 of the valve body 460 resulting in a force that urges the upper mandrel 403 in a direction towards the fluid regulator 448. The injection fluid 401 flows along the tube passage 404 to the end chamber 446. In the end chamber 446, the injection fluid 401 applies fluid pressure on a hydraulic area A2 444 of the second enlarged portion 472 of the lower mandrel 420 to produce a force that urges the lower mandrel 420 towards the inlet 468. The area A2 444 is greater than the area A1 406. Further, the fluid regulator 448 may be sized such that a flow of fluid out of the fluid regulator 448 is less than the fluid flow into the end chamber 446. Consequently, as fluid pressure within the end chamber 446 builds, the lower mandrel 420 is displaced from an initial position towards the inlet 468. As the lower mandrel 420 moves towards the inlet 468, the size of the spring chamber 421 is decreased causing fluid disposed therein to be evacuated into the well bore via the ports 418. Further, the spring 432 begins to compress and store energy.

As the lower mandrel 420 is further displaced towards the inlet 468, the spring 442 begins to compress while the valve body 460 remains in contact with the bearing surface 408 and fluid within the spring chamber 422 may be vented into the well bore through the ports 418. Compressing spring 442 stores energy. Further, the first enlarged portion 470 slides within the cavity 475 until a leading surface 485 engages a shoulder 486 of the upper mandrel 403. When the lower mandrel 420 engages the shoulder 486 of upper mandrel 403, the mandrels 403, 420 move together in a direction towards the inlet 468, causing the valve body 460 to unseat from the bearing surface 408. When the valve body 460 unseats, the pulse valve opens allowing a portion of the injection fluid 401 to flow out of the port 407, and into the well bore. Flow of some of the injection fluid 401 out of the port 407 into the well bore reduces the fluid pressure in the fluid pulse tool 450. Thus, the forces due to pressure acting on areas A1 406 and A2 444 decrease, reducing the compression force on the spring 442, which causes the spring 442 to expand. The expansion of the spring 442 further displaces the valve body 460 upward, further opening the pulse valve and allowing a greater amount of the injection fluid 401 to flow out of the well tool through the port 407. Thus, the fluid pulse tool 450 is in an open state. The spring 442 tends to push the valve body 460 to an open state rapidly.

The additional release of injection fluid 401 through the port 407 further decreases the pressure in the well tool and reduces the amount of injection fluid 401 conveyed through the tube passage 404 to the end chamber 446. Thus, the compression force applied to the spring 432 is reduced and the spring 432 begins to expand, displacing the lower mandrel 420 towards the fluid regulator 448. The upper and lower mandrels 403 and 420 move together since the first enlarged portion 470 urges the upper mandrel 403 via the lip 477. The return of the lower mandrel 420 to the initial position may occur quickly such that the lower mandrel engages the spring 445 to reduce or prevent the lower mandrel 420 from impacting the second end of the pulse tool 450. Return of the lower mandrel 420 to the initial position also increases the size of the spring chamber 421, drawing fluid from the well bore into the spring chambers 421 and 422 via the ports 418. When the lower mandrel 420 returns to the initial position, the valve body 460 is also returned to the bearing surface 408, closing the pulse valve. With the pulse valve in the closed state, the fluid pressure within the tool again increases and the process is repeated.

The action of the fluid pulse tool 450 described above results in a rapid opening and closing of the pulse valve while the flow rate of injection fluid 401 introduced into the fluid pulse tool 450 remains constant. This frequency at which the pulse valve is opened and closed is dampened by the movement of fluid into and out of the spring chambers 421, 422 via the ports 418. Consequently, altering the size or number of the ports 418 may affect the pulsing frequency of the fluid pulse tool 450. The opening and closing of valve body 460 can be damped via the restriction formed by ports 418. A greater restriction by ports 418 in the spring chamber 422 causes a greater damping against opening the valve body 460, because it slows entry of fluid into the spring chamber 422 needed to allow expansion of the springs 442. Correspondingly, a lesser restriction by ports 418 causes a lesser damping.

Figure 5:
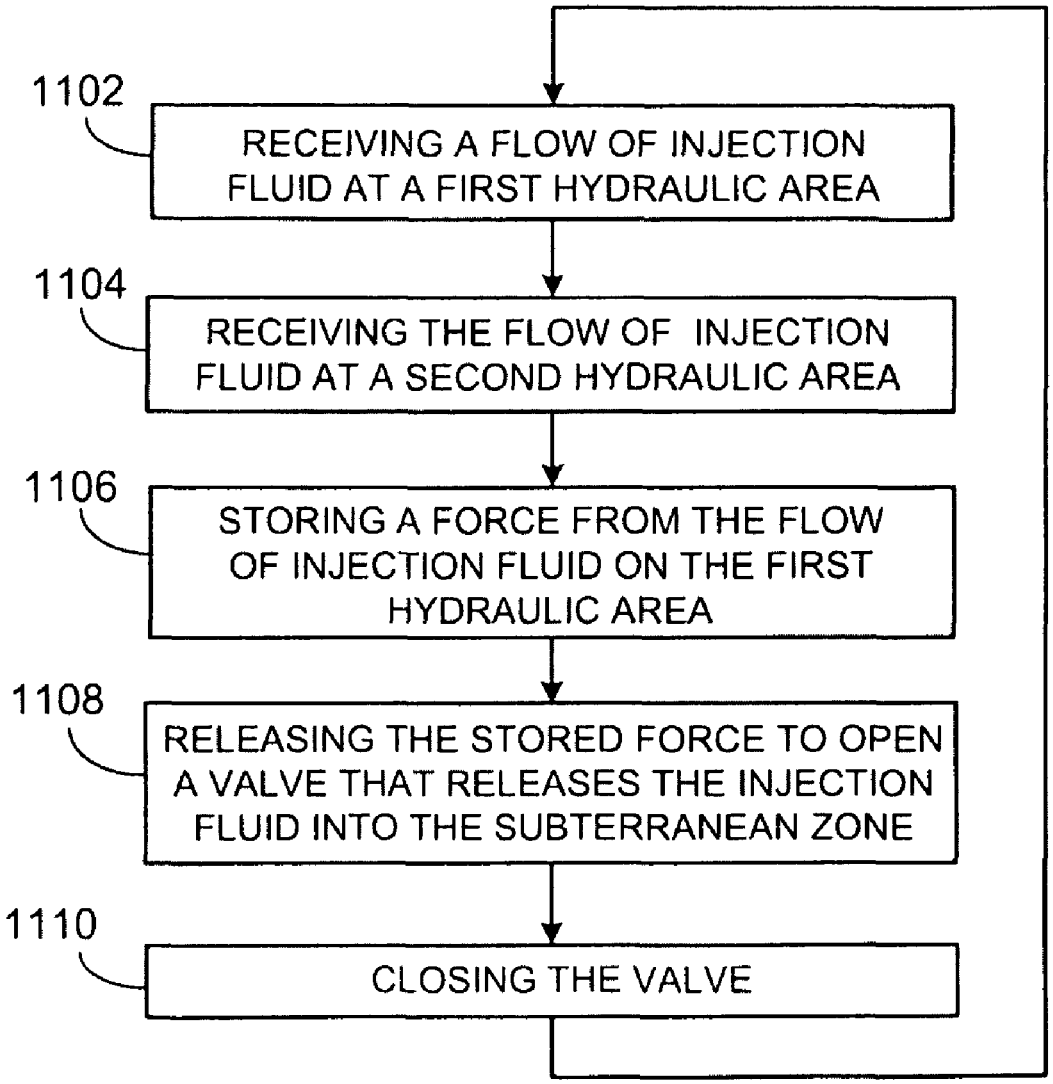
FIG. 5 is a flow chart of a method of injecting fluid into a subterranean zone with a pulse injection tool.

FIG. 5 is a flow diagram of a method 1100 for injecting pulsed fluid into a subterranean zone. At operation 1102, a flow of injection fluid is received at a first hydraulic area and the fluid pressure acting on the first hydraulic area generates a force. Concurrently, at operation 1104, the flow of injection fluid is received at a second, smaller hydraulic area. The fluid pressure of injection fluid acting on the second hydraulic area generates a force that biases a valve closed. The valve is configured to release the injection fluid into the subterranean zone when open and to substantially seal against release of injection fluid into the subterranean zone when in a closed position. For example, in reference to FIG. 3A, the pressure acting on hydraulic area A1 306 biases the pulse valve to prevent flow of fluid through port 307. Also, pressure acting on hydraulic area A2 344 generates a force. In reference to FIG. 4A, the pressure acting on hydraulic area A1 406 biases the pulse valve to prevent flow of fluid through port 407, and pressure acting on hydraulic area A2 444 generates a force.

Referring back to FIG. 5, at operation 1106, the force generated by the pressure acting on the first hydraulic area is stored. In certain instances, the force can be stored by compressing a spring with a body that is moving in response to the force generated at the first hydraulic area. For example, in reference to FIGS. 3B-3C, springs 322 and 332 are compressed by lower mandrel 320 to store force generated at hydraulic area A2 344. In reference to FIGS. 4A-4C, springs 432 and 442 are compressed to store force generated at hydraulic area A2 444.

Referring back to FIG. 5, at operation 1108, when the stored force exceeds a specified force, the stored force is released to open a valve that releases the injection fluid into subterranean zone. In certain instances, the specified force is a force sufficient to overcome the forces biasing the valve closed. In instances where the force is stored by compressing a spring, the stored force is released by expanding the spring. For example, in reference to FIGS. 3A-3D, the stored force is released from springs 322 when the compressional force in the spring exceeds the force generated at hydraulic area Al 306 (i.e. the specified force). Movement of the lower mandrel 320 downward is damped so that the spring 322 reacts against the lower mandrel 320 and drives the upper mandrel 303 and intermediate mandrel 314 upward to open the pulse valve. In reference to FIGS. 4A-4C, the stored force in spring 442 Is released when the compressional force in the spring exceeds the force generated at hydraulic area Al 406 (i.e. the specified force). Movement of the lower mandrel 420 is damped by ports 418 so that spring 445 reacts against the lower mandrel 420 and drives the upper mandrel 403 upward to open the pulse valve.

Referring back to FIG. 5, at operation 1110, the force acting to open the valve is released or overcome so that the valve may again be biased closed. For example, in reference to FIGS. 3A-3D, opening the pulse valve reduces the amount of fluid communicated into end chamber 346, and thus the amount of pressure in the end chamber 346. The lower pressure reduces the force generated on hydraulic area A2 344 relative to the amount of force generated on hydraulic area A1 306, because fluid is bypassed through ports 318. The reduced force at hydraulic area A2 344 allows the system to reset as upper mandrel 303 moves to close the pulse valve, for example by expanding spring 332. As discussed above, movement of the upper mandrel 303 to close the pulse valve is damped by fluid flow through the restricting orifice devices 316, so the pulse valve does not abruptly close. Similarly in FIGS. 4A-4C, opening the pulse valve reduce the amount of fluid communicated into end chamber 446, and thus the amount of pressure in the end chamber 446. The lower pressure reduces the force generated on hydraulic area A2 444 relative to the amount of force generated on hydraulic area A1 406, because fluid is bypassed through the ports 407. The reduced force at hydraulic area A2 444 allows the system to reset as upper mandrel 403 moves to close the pulse valve, for example by expanding spring 432. As discussed above, movement of the upper mandrel 403 to close the pulse valve is damped by fluid flow through the orifices 418.

Referring back to FIG. 5, operations 1102-1110 can be repeated to pulse flow into the subterranean zone. Because the pulsing is performed by the fluid pulsing tool, the flow of injection fluid can be provided at a constant rate.

Although described in the context of fluid injection, the injection tool and concepts described herein are applicable to other processes and purposes.

A number of implementations have been described. Nevertheless, it will be understood that various modifications may be made without departing from the spirit and scope of the present disclosure. Accordingly, other implementations are within the scope of the following claims.

What is claimed is:

1. A well tool operable to receive a flow of fluid, the well tool comprising:

a first hydraulic area on which the fluid acts tending to move a first body to substantially seal against passage of fluid through an aperture;

a second, larger hydraulic area on which the fluid acts tending to move a second body, the second body movable by the fluid acting on the second hydraulic area to displace the first body from substantially sealing against passage of fluid through the aperture; and an energy storing device configured to store energy from movement of the second body until at least a specified amount of energy is stored and to release the energy when the second body is moved to displace the first body from substantially sealing against passage of fluid through the aperture.

2. The well tool of claim 1, further comprising a dampener adapted to dampen movement of the first body by the fluid acting on the first hydraulic area.

3. The well tool of claim 1, wherein the energy storing device is a spring.

4. The well tool of claim 3, wherein the spring releases stored energy by expanding and is operable to move the second body away from the first body, and wherein the well tool further comprises a dampener adapted to dampen movement of the second body in response to expansion of the spring.

5. The injection tool of claim 1 wherein the first hydraulic area is upstream of the second hydraulic area and the fluid flow is communicated to the second hydraulic area through the first and second bodies.

6. The injection tool of claim 1 further comprising a fluid regulator downstream of the first and second hydraulic areas, the fluid regulator adapted to regulate a pressure of the fluid flow.

7. The injection tool of claim 6 wherein the fluid regulator comprises at least one of an orifice having a specified restriction, an orifice having an adjustable restriction, or a pressure relief valve.

8. The injection tool of claim 1 further comprising a fluid accumulator upstream of the aperture.

9. A method of pulsing injection fluid into a subterranean zone comprising:

receiving a fluid at a first hydraulic area;

storing a force from the fluid acting on the first hydraulic area;

releasing the stored force to open a valve that releases an injection fluid into subterranean zone when the stored force exceeds a specified force; and receiving the fluid at a second, smaller hydraulic area, the fluid acting on the second hydraulic area biasing the valve closed and wherein the specified force comprises a force sufficient to overcome the bias.

10. The method of claim 9 wherein opening the valve reduces the force from the fluid acting on the first hydraulic area and further comprising closing the valve in response to the fluid acting on the first hydraulic area.

11. The method of claim 10 further comprising dampening closing the valve.

12. The method of claim 9 further comprising repeating the operations of storing the force and releasing the stored force.

13. The method of claim 9 wherein storing the force comprises compressing a spring with a body moving in a first direction in response to the force from the fluid at the first hydraulic area.

14. The method of claim 13 wherein releasing the stored force comprises expanding the spring and wherein movement of the body in a second direction opposite the first direction is damped.

15. The method of claim 9 further comprising regulating a pressure of the flow of fluid downstream of the first hydraulic area.

16. The method of claim 9 further comprising accumulating a portion of a flow of injection fluid upstream of the valve and releasing the accumulated portion of the flow of injection fluid in response to opening the valve.

17. A method comprising:

receiving a fluid at a first hydraulic area of a downhole tool;

receiving a fluid at a second hydraulic area of the downhole tool; and cyclically storing a force from the fluid acting on the second hydraulic area and releasing the stored force to overcome a force from the fluid acting on the first hydraulic area.

18. The method of claim 17 wherein the fluid received at the second hydraulic area comprises the fluid received at the first hydraulic area.

19. The method of claim 17 further comprising reducing the force from fluid acting on the second hydraulic area in response to overcoming the force from the fluid acting on the first hydraulic area.

* * * * *